US010814953B2

(12) United States Patent
Karila et al.

(10) Patent No.: US 10,814,953 B2
(45) Date of Patent: Oct. 27, 2020

(54) PROPULSION UNIT PROVIDED WITH A STEERING ARRANGEMENT

(71) Applicant: ABB Oy, Helsinki (FI)

(72) Inventors: Kai Karila, Vantaa (FI); Jukka Laine, Helsinki (FI); Suvi Westerlund, Tampere (FI); Hannu Vihtanen, Ylöjärvi (FI); Jukka-Pekka Uusitalo, Kangasala (FI)

(73) Assignee: ABB Oy, Helsinki (FI)

( * ) Notice: Subject to any disclaimer, the term of this patent is extended or adjusted under 35 U.S.C. 154(b) by 108 days.

(21) Appl. No.: 16/237,822

(22) Filed: Jan. 2, 2019

(65) Prior Publication Data

US 2019/0135402 A1 May 9, 2019

Related U.S. Application Data

(63) Continuation of application No. PCT/FI2016/050487, filed on Jul. 1, 2016.

(51) Int. Cl.
*B63H 5/125* (2006.01)
*B63H 25/42* (2006.01)
(Continued)

(52) U.S. Cl.
CPC ..... *B63H 25/42* (2013.01); *B63H 5/125* (2013.01); *B63H 20/12* (2013.01); *B63H 20/16* (2013.01); *B63H 2005/1258* (2013.01)

(58) Field of Classification Search
CPC ..... B63H 20/12; B63H 20/16; B63H 21/265; B63H 2005/1254; B63H 2005/1256; B63H 2005/1258; B63H 25/42
See application file for complete search history.

(56) References Cited

U.S. PATENT DOCUMENTS 7,263,943 B2 * 9/2007 Takada ..... B63H 20/12 114/144 E
9,376,198 B2 * 6/2016 Anderson ..... B63H 5/1252
(Continued)

FOREIGN PATENT DOCUMENTS

GB 526789 A 9/1940
WO 0015495 A1 3/2000
WO 0037308 A1 6/2000

OTHER PUBLICATIONS

European Patent Office, Supplementary Search Report issued in corresponding Application No. 16907186.7, dated May 31, 2019, 8 pp.

(Continued)

*Primary Examiner* — Andrew Polay
(74) *Attorney, Agent, or Firm* — Taft Stettinius & Hollister LLP; J. Bruce Schelkopf

(57) ABSTRACT

The arrangement includes at least one steering electric motor rotating the propulsion unit via a force transmission arrangement. The force transmission arrangement includes a differential including a first shaft connected to the steering electric motor, a second shaft connected to the propulsion unit, and a third shaft connected to a brake device. The third shaft is locked from rotation when a torque produced by an external force on the propulsion unit is below a threshold value, whereby power is distributed only from the steering electric motor to the propulsion unit or vice a versa. The third shaft is allowed to start rotating when the torque produced by the external force on the propulsion unit exceeds the threshold value, whereby power is distributed from the steering electric motor to the rotation of the propulsion unit and to the brake device or from the rotation of the propulsion unit to the steering electric motor and to the brake device.

20 Claims, 5 Drawing Sheets

(51) Int. Cl.
*B63H 20/16* (2006.01)
*B63H 20/12* (2006.01)

(56) References Cited

U.S. PATENT DOCUMENTS

| | | | | |
|---|---|---|---|---|
| 9,969,479 | B2 * | 5/2018 | De Bruin | B63H 25/22 |
| 2004/0029460 | A1 | 2/2004 | Hartig et al. | |

OTHER PUBLICATIONS

Finnish Patent Office, International Search Report & Written Opinion issued in corresponding Application No. PCT/FI2016/050487, dated Oct. 19, 2016, 10 pp.

* cited by examiner

PROPULSION UNIT PROVIDED WITH A STEERING ARRANGEMENT

FIELD

The present invention relates to a propulsion unit provided with a steering arrangement.

BACKGROUND

External propulsion units are used more and more today especially in big vessels. The propulsion unit extends downwards from a bottom of a hull of a vessel. The propulsion unit may comprise a hollow strut with an upper portion and a lower portion.

The upper portion of the strut may form a support arm supporting the lower portion of the strut.

The lower portion of the strut may form a longitudinal compartment. A propeller shaft may be rotatably supported within the compartment. A propeller may be attached to an outer end of the propeller shaft outside an end of the lower portion of the strut. The propeller shaft may be driven by a driving motor positioned in the lower portion of the strut or in the upper portion of the strut or within the vessel. The driving motor may be an electric motor.

An upper end of the upper portion of the strut may be attached to a gearwheel positioned within the hull of the vessel. The gearwheel may be turned 360 degrees around a centre axis of rotation with at least one steering electric motor. The at least one steering electric motor may be connected operatively via a force transmission to the gearwheel in order to turn the gearwheel and thereby the propulsion unit.

External loads caused by e.g. ice or a bottom contact may produce a torque on the propulsion unit. These external loads may cause an external turning torque on the propulsion unit counteracting the turning torque produced by the steering electric motor. There is a risk that the force transmission e.g. the cogs in the force transmission may brake due to the heavy loads.

SUMMARY

An object of the present invention is to improve prior art propulsion units provided with a steering arrangement.

The propulsion unit provided with the steering arrangement is defined in claim 1.

The steering arrangement comprises:

at least one steering electric motor for rotating the propulsion unit via a force transmission arrangement arranged between the propulsion unit and the steering electric motor, the force transmission arrangement comprises a differential comprising a first shaft rotationally connected to the steering electric motor, a second shaft rotationally connected to the propulsion unit, and a third shaft rotationally connected to a brake device, the third shaft is locked from rotation when a torque produced by an external force on the propulsion unit is below a threshold value, whereby power is distributed only from the steering electric motor to the rotation of the propulsion unit or vice a versa, and the third shaft is allowed to start rotating when the torque produced by the external force on the propulsion unit exceeds the threshold value, whereby power is distributed from the steering electric motor to the rotation of the propulsion unit and to the brake device or from the rotation of the propulsion unit to the steering electric motor and to the brake device.

The use of the differential in the force transmission arrangement between the steering electric motor and the propulsion unit makes it possible to limit the maximum torque that acts on the propulsion unit and the transmission in fast overload situations in which the electric motor will cause big torques on the propulsion unit and the force transmission due to the big moment of inertia of the electric motor. When the propulsion unit is turned with high torque (an over torque situation) due to an external force on the propulsion unit, the inertia of the steering electric motor is multiplied through the planetary gear by a factor of $g^2$, where g is the gear ratio of the planetary gear. The gear ratio of a steering electric motor is also high. The inertia and thus the counter torque from the steering electric motor becomes so high that the force transmission may in some cases brake.

One of the main ideas in the invention is to provide a secondary low inertia route for the over torque. The power is transmitted through the differential to a brake device that is allowed to spin when a threshold torque (the over torque) produced by the external force is reached. The differential reduces the torque of the steering electric motor acting on the force transmission arrangement during an over torque situation.

The expression stating that a first part is "operatively connected" to a second part means in this application that the first part and the second part may be either connected directly or they may be connected indirectly. The first part and the second part may thus be connected indirectly through a third part or through several third parts. The term "operatively connected" means that power can be transmitted through the connection between the parts.

DRAWINGS

In the following the invention will be described in greater detail by means of preferred embodiments with reference to the attached drawings, in which.

DETAILED DESCRIPTION

Figure 1:
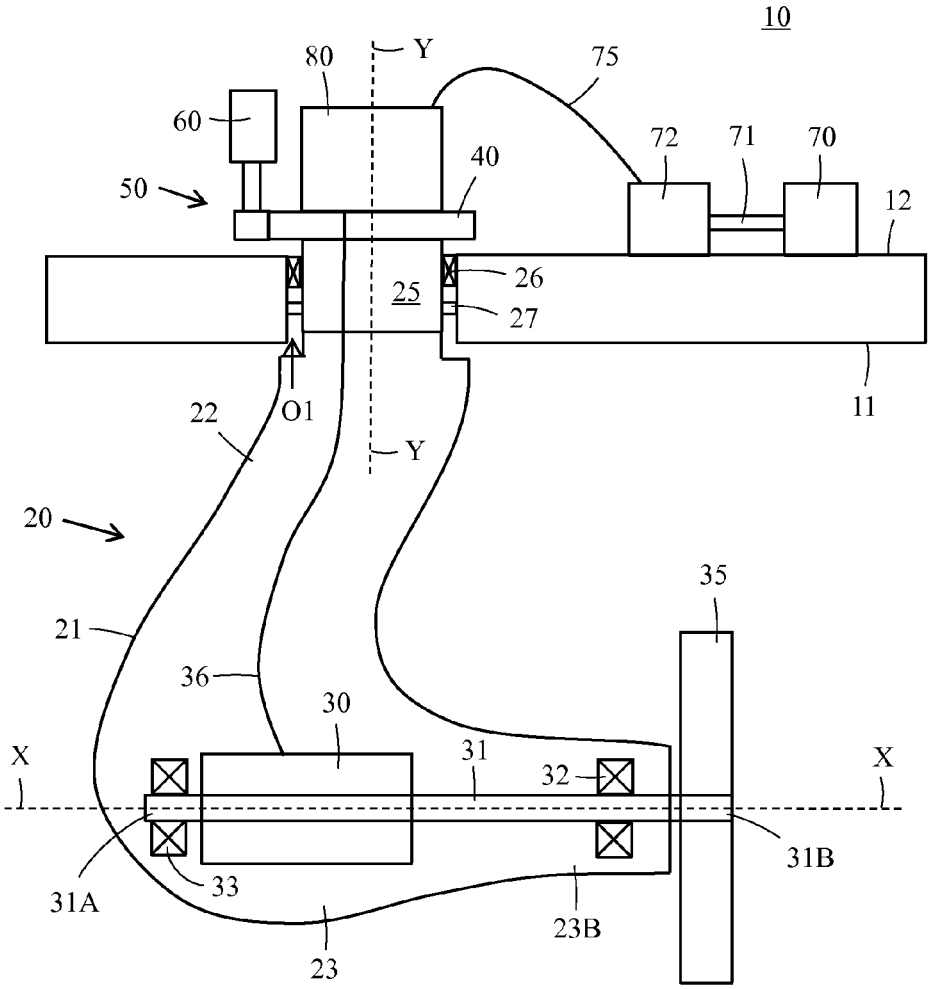
FIG. 1 shows a cross section of a propulsion unit of a vessel.

FIG. 1 shows a vertical cross section of a propulsion unit of a vessel. The vessel 10 has a double bottom i.e. a first outer bottom 11 forming the hull of the vessel and a second inner bottom 12. The propulsion unit 20 extends downwards from a hull of the vessel 10. The propulsion 20 unit may comprise a hollow strut 21 with an upper portion 22 and a lower portion 23. The upper portion 22 of the strut 21 may form a support arm supporting the lower portion 23 of the strut.

The upper portion 22 of the strut 21 of the propulsion unit 20 may be connected to a support cylinder 25. The support cylinder 25 may pass through an opening O1 formed in the bottom of the vessel 10. The opening O1 may extend between the first outer bottom 11 and the second inner bottom 12 of the vessel 10. The support cylinder 25 may be rotatably attached with a slewing bearing 26 to the hull of the vessel 10. The support cylinder 25 could instead of being a separate entity as is shown here be formed as an integral portion of the upper portion 22 of the strut 21. The support cylinder 25 would thus form an upper end portion of the upper portion 22 of the strut 21. A slewing seal 27 may be positioned under the slewing bearing 26 in order to prevent leakage of hydraulic fluid from the slewing bearing 26 to the sea and sea water from penetrating into the interior of the hull of the vessel 10 through the passage between the rotating support cylinder 25 and the inner circumference of the opening O1.

The lower portion 23 of the strut 21 may form a longitudinal compartment. The compartment may comprise a propeller shaft 31 comprising a first end 31A and a second end 31B. The propeller shaft 31 may be rotatably supported with bearings 32, 33 within the lower portion 23 of the strut 21. The axial centre line X-X of the propeller shaft 31 may form a shaft line. At least one end 31B of the propeller shaft 31 may protrude out from an end of the lower portion 23 of the strut 21. The end of the propeller shaft 31 that protrudes out from the lower portion 23 of the strut 21 may be sealed with a water seal in the shaft opening in the lower portion 23 of the strut 21. At least one propeller 35 may be connected to the outer end 31B of the propeller shaft 31. The propeller shaft 31 may on the other hand also protrude from both ends of the lower portion 23 of the strut 21. A propeller 35 may thus be positioned on both ends of the propeller shaft 31. The propeller shaft 31 could naturally also be provided with several propellers 35 on each end 31A, 31B of the propeller shaft 31. The propeller shaft 31 is driven by a driving motor 30. The driving motor 30 may be positioned within the lower portion 23 of the strut 21 or within the upper portion 22 of the strut 21 or within the vessel 10. The driving motor 30 may in case it is positioned in the lower portion 23 of the strut 21 be directly connected to the propeller shaft 31. The driving motor 30 may in case it is positioned in the upper portion 22 of the strut 21 or within the vessel be connected via a vertical shaft to the propeller shaft 31. The driving motor 30 may be a driving electric motor 30.

A gearwheel 40 may be positioned within the hull 11, 12 of the vessel 10. An upper end of the support cylinder 25 may be attached to the gearwheel 40. The gearwheel 40 may be turned 360 degrees or less around the centre axis Y-Y of rotation with a driving arrangement. The driving arrangement may comprise at least one steering electric motor 60 rotating the gearwheel 40 through a force transmission arrangement 50. There may be several e.g. four similar steering electric motors 60 connected through a respective force transmission arrangement 50 to the gearwheel 40. The turning of the gearwheel 40 will turn the propulsion unit 20. The gearwheel 40 may have a ring form with a hole in the middle. The gearwheel 40 may be provided with cogs on the outer or inner perimeter of the gearwheel 40. The cogs of the gearwheel 40 are connected to respective cogs in the force transmission arrangement 50.

A prime mover 70 is positioned within the vessel 10 and a generator 72 connected with a shaft 71 to the prime mover 70. The prime mover 70 may be a combustion engine or any other suitable engine for driving the generator 72. The generator 72 produces electric energy needed within the vessel 10 and within the propulsion unit 20. There may be several prime movers 70 and generators 72 in a vessel 10.

A slip ring arrangement 80 may be arranged within the vessel 10 in connection with the gearwheel 40. Electric power is transferred from the generator 72 to the slip ring arrangement 80 with a first cable 75. Electric power is further transferred from the slip ring arrangement 80 to the driving electric motor 30 with a second cable 36. The slip ring arrangement 80 is needed in order to transfer electric power between the stationary hull 10 of the vessel and the rotating propulsion unit 20.

Figure 2:
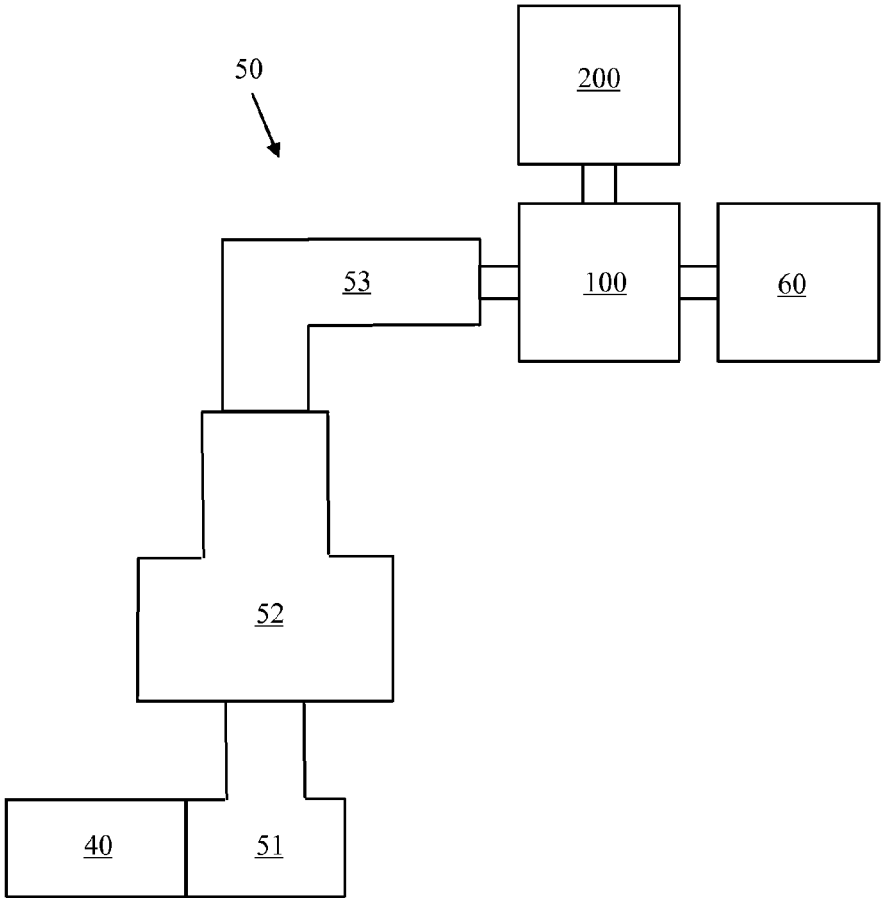
FIG. 2 shows a block diagram of a first embodiment of a driving arrangement of a gearwheel.

FIG. 2 shows a block diagram of a first embodiment of a driving arrangement of a gearwheel. The driving arrangement comprises a force transmission arrangement 50 connected to the gearwheel 40. The force transmission arrangement 50 may comprise a main pinion gear 51 meshing with the gearwheel 40, a planetary gear 52 connected to the main pinion gear 51, and an angel transmission 53 connected to the planetary gear 52. The force transmission arrangement 50 may further comprise a differential 100 connected to the angel transmission 53. The steering electric motor 60 is connected to the differential 100. A brake device 200 is further connected to the differential 100.

The differential 100, the angle transmission 53, the planetary gear 52 and the main pinion gear 51 transfer power from the steering electric motor 60 to the gearwheel 40 and reduce the rotation speed to a suitable level for rotating the propulsion unit 20. The angle transmission 53 redirects the power distribution by 90 degrees making it possible to have the steering electric motor 60 in a horizontal position. The steering electric motor 60 could, however, also be in a vertical position, whereby the angle transmission 53 could be left out.

The brake device 200 is used to restrict the torque produced by external forces on the gearwheel 40 to a predetermined threshold value.

In normal operational conditions, when the torque produced by external forces on the gearwheel 40 does not exceed the threshold value, the brake 200 will keep the third shaft 141 of the differential 100 i.e. the shaft connected operatively to the brake device 200 locked against rotation. The power is thus distributed only from the steering electric motor 60 via the transmission 50 to the gearwheel 40 or vice a versa.

In abnormal operational conditions, when the torque produced by external forces on the gearwheel 40 exceeds the threshold value, the brake device 200 will allow the third shaft 141 of the differential 100 i.e. the shaft connected operatively to the brake device 200 to start to rotate. The power is thus distributed from the steering electric motor 60 to the gearwheel 40 and to the brake device 200 or from the gearwheel 40 to the steering electric motor 60 and to the brake device 200.

The brake device 200 may allow the third shaft 141 of the differential 100 to rotate when an external force acting on the propulsion unit 200 exceeds the threshold value of the torque of the gearwheel 40. An external force acting of the propulsion unit 20 may be caused e.g. by ice or by a bottom contact. The external force may cause a torque in an opposite direction on the gearwheel 40 in relation to the torque caused by the steering electric motor 60. The brake device 200 allows the third shaft 141 of the differential 100 to start to rotate. A first portion of the power of the steering electric motor 60 may be transferred to the brake device 200 when the brake device 200 allows the third shaft 141 of the differential 100 to start to rotate. A second portion of the power of the steering electric motor 60 is still transferred to the gearwheel 40.

The planetary gear 52 is in this first embodiment connected directly to the main pinion gear 51 and the differential 100 is connected between the planetary gear 52 (or actually the angle gear 53) and the steering electric motor 60. The brake device 200 needed in this first embodiment is small.

The inertia of the brake device 200 is, however, multiplied by the gear factor g as in prior art solutions. The planetary gear 52 must be able to withstand a rather big torque in this solution.

Figure 3:
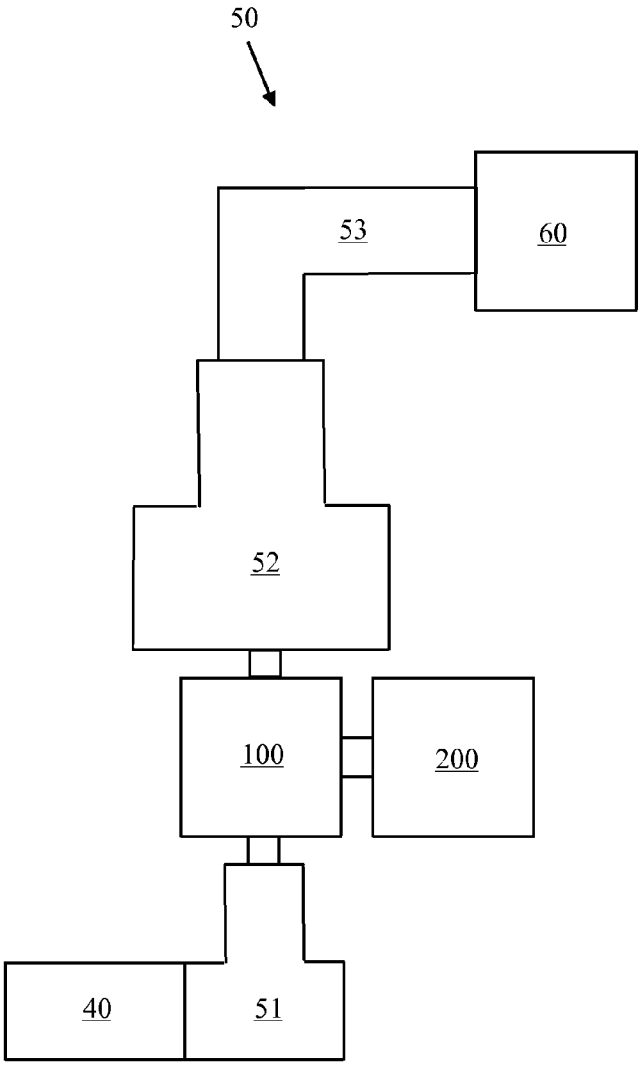
FIG. 3 shows a block diagram of a second embodiment of a driving arrangement of a gearwheel.

FIG. 3 shows a block diagram of a second embodiment of a driving arrangement of a gearwheel. The driving arrangement in this second embodiment differs from the driving arrangement in the first embodiment only in the position of the differential 100. The differential 100 is in this second embodiment positioned between the pinion gear 51 and the planetary gear 52.

The inertia of the brake device 20 is very low in this second embodiment. The system is thus very likely to survive over torque situations. The torque of the brake device 200 should on the other hand be high in this second embodiment. This second embodiment could be modified by adding a smaller additional planetary gear between the differential 100 and the brake device 200. This solution with the additional planetary gear would decrease the required braking torque, but increase the number of components.

The invention is not limited to the force transmission arrangements 50 shown in FIG. 2 or 3, but can be used in connection with any kind of force transmission arrangement 50 between the steering electric motor 60 and the gearwheel 40. The force transmission arrangement 50 reduces the rotation speed of the steering electric motor 60 to a suitable rotation speed for the gearwheel 40. The gear ratio may be e.g. 1:3000 i.e. when the steering electric motor 60 rotates with 3000 rpm, then the gearwheel 40 rotates with 1 rpm. The gear ratio will also increase the torque that the steering electric motor 60 produces on the gearwheel 40.

Figure 4:
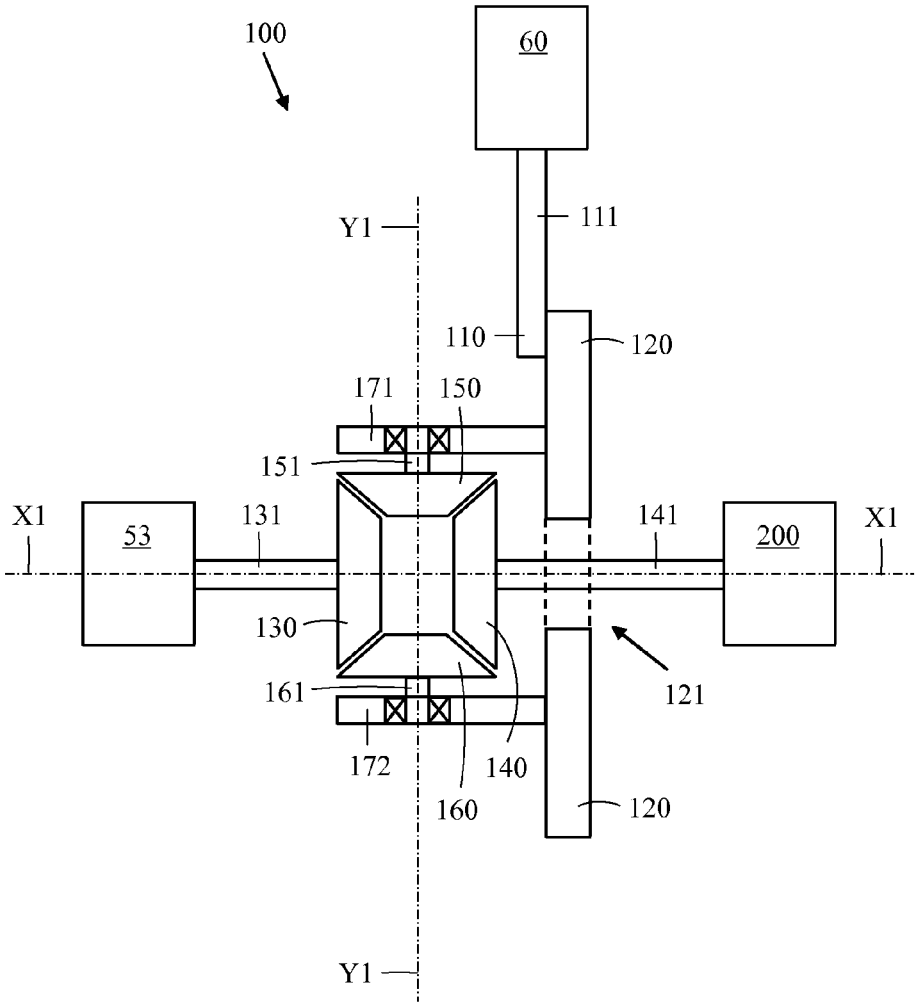
FIG. 4 shows a cross section of a differential.

FIG. 4 shows a cross section of a differential. The differential 100 comprises three shafts 111, 131, 141. The three shafts 111, 131, 141 are connected with cog wheels within the transmission so that power can be distributed between the shafts 111, 112, 113. A differential may be operated so that a power source is connected to a first shaft 111 of the differential 100, whereby a second shaft 131 and a third shaft 141 of the differential 100 rotate when the power source rotates the first shaft 111. The second shaft 131 and the third shaft 141 of the differential 100 may, however, rotate at different speeds. The first shaft 111 of the differential 100 may be considered to form an input shaft 111 of the differential 100. The second shaft 131 and the third shaft 141 of the differential 100 may be considered to form a first output shaft 131 and a second output shaft 141 of the differential 100.

The first shaft 111 of the differential 100 is connected within the differential 100 to a pinion gear 110 being meshed with a ring gear 120. The rotation axis of the pinion gear 110 and the rotation axis of the ring gear 120 are perpendicular in relation to each other.

Each of the second shaft 131 and the third shaft 141 of the differential 100 is connected within the differential 100 to a respective side gear 130, 140. The side gears 130, 140 are positioned at a distance from each other in a centre portion of the differential 100. The rotation axis X1-X1 of the first side gear 130 is concentric with the rotation axis X1-X1 of the second side gear 140. The rotation axis X1-X1 of the first side gear 130 and the rotation axis X1-X1 of the second side gear 140 are further concentric with the rotation axis X1-X1 of the ring gear 120.

The differential 100 comprises further two opposite parallel spider gears 150, 160 positioned at a distance from each other. Each spider gear 150, 160 is meshed with both side gears 150, 160. The rotation axis Y1-Y1 of the first spider gear 150 is concentric with the rotation axis Y1-Y1 of the second spider gear 160. The rotation axes Y1-Y1 of the spider gears 150, 160 are perpendicular with the rotation axes X1-X1 of the ring gear 120. Each spider gear 150, 160 may be rotatably supported with a shaft 151, 161 on a spider frame 171, 172. Each spider frame 171, 172 may be fixedly supported on the ring gear 120. Each spider gear 150, 160 is thus free to make two kinds of rotations i.e. the spider gear 150, 160 may rotate along with the ring gear 120 and on its own axis. The differential 100 may comprise only one spider gear 150, 160, but two spider gears 150, 160 are preferred. Two spider gears 150, 160 may carry a greater load through the differential 100. It is possible to use even more than two spider gears 150, 160 e.g. four spider gears 150, 160 if needed.

The ring gear 120 comprises an opening 121 in the middle portion of the ring gear 120 so that the third shaft 141 i.e. the shaft 141 of the second side gear 140 can freely extend through the opening 121 in the ring gear 120 and further out of the casing of the differential 100.

The side gears 130, 140 and the spider gears 150, 160 are bevelled gears arranged in a rectangular form so that the side gears 130, 140 are on opposite sides of the rectangle and the spider gears 150, 160 are on opposite sides of the rectangle.

The rotation axis of the first shaft 111 of the differential 100 i.e. the shaft 111 of the pinion gear 110 is perpendicular to the rotation axes X1-X1 of the output shafts 131, 141 of the differential i.e. the shafts 131, 141 of the side gears 130, 140. The rotation axis of the first shaft 111 of the differential 100 extends in a radial direction in relation to the rotation axis X1-X1 of the ring gear 120. The first shaft 111 of the differential 100 may be positioned at any angular position in relation to the rotation axis X1-X1 of the ring gear 120.

The figure does not for clarity reasons show the casing of the differential 100. The first shaft 111 of the differential 100, the output shafts 131, 141 of the differential 100, and the ring gear 120 are naturally all rotatably supported via bearing means within the casing of the differential 100.

The power distribution from the first shaft 111 of the differential 100 to the output shafts 131, 141 of the differential 100 follows the following pattern. The power is first transferred from the first shaft 111 via the pinion gear 110 to the ring gear 120. The power is then transferred from the ring gear 120 to the spider gears 150, 160. Finally from the spider gears 150, 160 power gets transferred to both side gears 130, 140 and thereby to the output shafts 131, 142.

When both side gears 130, 140 rotate with the same speed, then the spider gears 150, 160 rotate along with the ring gear 120, but they do not rotate around their own axis 151, 161.

The steering electric motor 60 is connected to the first shaft 111 of the differential 100 i.e. the shaft 111 of the pinion gear 110. The angle transmission 53 is connected to the second shaft 131 of the differential 100 i.e. the shaft 131 of the first side gear 130. The brake device 200 is connected to the third shaft 141 of the differential 100 i.e. the shaft 141 of the second side gear 140.

A predetermined brake force can be set to the brake device 200.

The third shaft 141 is locked from rotation when a torque rotating the propulsion unit 20 is below a threshold value, whereby power is distributed only from the steering electric motor 60 to the rotation of the propulsion unit 20 or vice a versa.

The third shaft 141 is allowed to start rotating when the torque rotating the propulsion unit 20 exceeds the threshold value, whereby power is distributed from the steering electric motor 60 to the rotation of the propulsion unit 20 and to the brake device 200 or from the rotation of the propulsion unit 20 to the steering electric motor 60 and to the brake device 200.

When the third shaft 141 of the differential 100 is locked, then also the second side gear 140 is locked. The power from the steering electric motor 60 is then transferred from the ring gear 120 via the rotating spider gears 150, 160 to the second shaft 131 of the differential 100 and thereby to the gearwheel 40. An external force e.g. caused by ice may act on the propulsion unit 20 in a rotation direction opposite to the rotation direction caused by the steering motor 60. This external force is also transferred from the gearwheel 40 through the transmission 50 to the steering electric motor 60.

When the third shaft 141 of the differential 100 is allowed to rotate, then also the second side gear 140 is allowed to rotate. The brake device 200 is still connected which means that the brake device 200 will counteract the rotation of the second side gear 140. The third shaft 141 of the differential 100 will thus rotate at a lower speed compared to the rotation speed of the second shaft 131 of the differential 100. A part of the force of the steering electric motor 60 is transferred to the third shaft 141 of the differential 100 and thereby to the brake device 200. The same applies to an external force acting on the propulsion unit 20. A part of said external force is transferred to the third shaft 141 on the differential 100 and thereby to the brake device 200.

The connection of the steering electric motor 60, the brake device 200 and the gearwheel 40 to the shafts 111, 131, 141 of the differential 100 need not be that shown in the FIG. 4. The brake device 200 may be connected operatively to the second shaft 131 or to the third shaft 141 of the differential 100. The gearwheel 40 may be connected operatively to the first shaft 111 or to the one of the second shaft 131 and the third shaft 141 that is not connected to the brake device 200. The steering electric motor 60 may then finally be connected operatively to the remaining one of the three shafts 111, 131, 141. There are thus several possibilities of connecting the brake device 200, the steering electric motor 60 and the gearwheel 40 to the differential 100.

Figure 5:
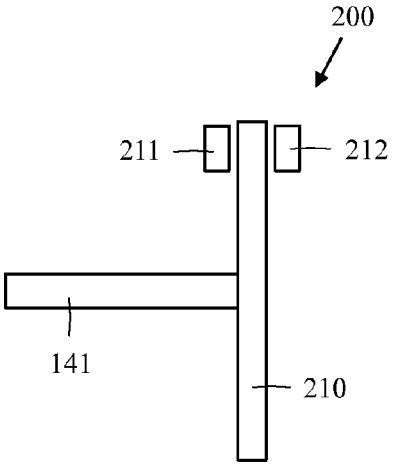
FIG. 5 shows a first embodiment of a brake device.

FIG. 5 shows a first embodiment of a brake device. The brake device comprises a brake surface 210, which may be in the form of a brake disc 210 connected to the third shaft 141 of the differential 100 and at least one brake pad 211, 212 acting on the brake surface 210. There may be two brake pads 211, 121 acting an opposite side surfaces of a brake disc 2120. The brake pads 211, 212 may be operated e.g. with hydraulics or with a gas or with some other actuator. The brake pads 211, 212 are pressed against the opposite side surfaces of the brake disc 210 with a predetermined brake force causing a friction force between the brake pads 211, 212 and the brake disc 210 preventing the brake disc 210 from slipping in relation to the brake pads 211, 212 in normal operational conditions. The torque rotating the propulsion unit 20 in normal operational conditions does not exceed the friction force between the brake pads 211, 212 and the brake disc 210 when the predetermined brake force is used. The torque rotating the propulsion unit 20 in abnormal operational conditions exceeds the friction force between the brake pads 211, 212 and the brake disc 210 when the predetermined brake force is used, whereby the brake disc 210 starts to slip in relation to the brake pads 211, 212. The brake surface 210 could instead of being formed of a disc be formed of a drum. The at least one brake pad 211, 212 would then act on the drum.

Figure 6:
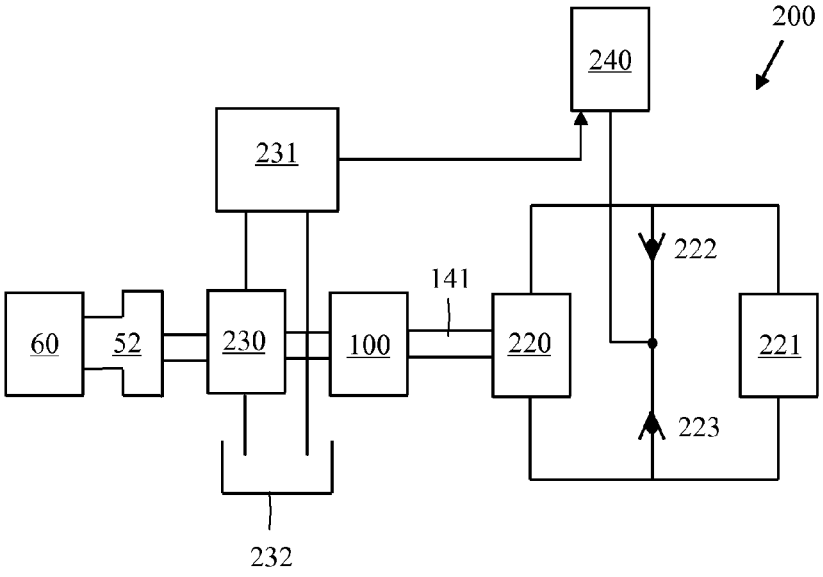
FIG. 6 shows a second embodiment of a brake device.

FIG. 6 shows a second embodiment of a brake. The brake comprises a hydraulic motor 220, a hydraulic pump 230, a hydraulic accumulator 240, a pressure relief valve 221, charge valves 231, a tank 232 and necessary conduits. The hydraulic motor 220 is connected to the third shaft 141 of the differential 100 and the hydraulic pump 230 is connected to the shaft connecting the differential 100 with the planetary gear 52. The hydraulic motor 220 is connected via hydraulic conduits to the pressure relief valve 221. The hydraulic accumulator 240 is further connected to the conduits connecting the hydraulic motor 220 and the pressure relief valve 221 via one way valves 222, 223. The accumulator 222 may be e.g. a gas charged accumulator forming a reservoir of hydraulic fluid for the hydraulic brake circuit.

The hydraulic pump 230 pumps hydraulic fluid from the tank 232 via the charge valves 231 either to the hydraulic accumulator 240 or back to the tank 232. The charge valves 231 direct the hydraulic fluid from the hydraulic pump 230 to the hydraulic accumulator 240 when the hydraulic fluid level in the hydraulic accumulator 240 decreases i.e. when there is need to fill the hydraulic accumulator 240. The charge valves 231 direct the hydraulic fluid from the hydraulic pump 230 back to the tank 232 when the hydraulic accumulator 240 is full i.e. there is no need to fill the hydraulic accumulator 240.

The rotation of the hydraulic motor 220 is prevented when the pressure relief valve 221 is closed i.e. flow of hydraulic fluid in the hydraulic circuit between the hydraulic motor 220 and the pressure relief valve 221 is prevented. There may be some leakage of hydraulic fluid in the hydraulic motor 220 e.g. through seals in the hydraulic motor 220, which means that fresh hydraulic fluid may be brought into the hydraulic circuit in order to keep the hydraulic circuit operational. The hydraulic circuit is filled with hydraulic fluid from the hydraulic accumulator 240 via the one way valves 222, 223 when the pressure in the hydraulic circuit at either side of a one way valve 222, 223 decreases below the pressure of the hydraulic accumulator 240.

The moment of inertia of the electric steering motor 60 is much higher than the moment of inertia of the hydraulic motor 220. The hydraulic motor 220 with its pressure relief valve 221 cuts the torque peak to a level the transmission 50 can handle. Hydraulic fluid runs through the pressure relief valve 221 to the hydraulic accumulator 222. New, cool hydraulic fluid is received from the hydraulic accumulator 222. The situation can be seen as a power split from the propulsion unit 20 to the hydraulic motor 220, while the electric steering motor 60 is turned very slowly. The power split is determined by the ratio of the moment of inertia of the electric steering motor 60 and the moment of inertia of the hydraulic motor 220. When the torque from the propulsion unit 20 is reduced to a level below the threshold value of the pressure relief valve 221, the electric steering motor 60 takes over the control again.

Hydraulics has a high power and a high force/torque density. The high torques of the propulsion unit 20 can be handled with relatively small hydraulic components. This is especially the case when planetary gears are used. The heat produced in a collision to ice (an over torque situation) can also be handled smoothly with hydraulics, even if repeated collisions would occur. The heat produced in the hydraulic fluid in the hydraulic circuit may be handled in several ways. A cooler may e.g. be arranged in the hydraulic fluid circuit in order to cool the hydraulic fluid.

The trigger torque level (when the brake device is spinned) of the hydraulic motor can be set very precisely. It does not depend on the temperature or the time that has passed since the last over torque event. The trigger torque is defined by the pressure limit setting and it can be set by hand to a desired constant value (passive pressure limit).

If the pressure limit is realized with an active valve, the over torque level can be adjusted online to lower the over torque experienced by the system. This can be a desired option in some fault situations or during testing and installation phases of the system.

The hydraulic motor may be used from time to time so that the rotor of the hydraulic motor spins. The time interval for the consecutive spins of the rotor of the hydraulic motor is determined by the manufacturer of the hydraulic motor. When no collision on ice occur, an adjustable pressure limit or a small separate two-way proportional valve, or maybe even an on/off valve, in parallel with the passive pressure limit can be used to spin the rotor of the hydraulic motor from time to time. This can be done in such way that the steering of the propulsion unit 20 is not affected. The power needed to spin the rotor of the hydraulic motor is really small.

The brake device shown in FIG. 6 is to be seen as one example of a hydraulic brake device 200 that can be used in the invention. In the hydraulic brake device 200 there may be a hydraulic motor 220 connected to the third shaft of the differential 100 and some hydraulic valve means 221 for restricting the flow of hydraulic fluid through the hydraulic motor 220. The idea is thus to use the hydraulic valve means 221 to lock and unlock the hydraulic motor 220 against rotation. Hydraulic fluid is prevented from flowing through the hydraulic motor 220 when the hydraulic valve means 221 is closed, whereby the hydraulic motor 220 is prevented from rotating. Hydraulic fluid may flow through the hydraulic motor 220 when the hydraulic valve means 221 is opened, whereby the hydraulic motor 220 may rotate. A refill of hydraulic fluid to the hydraulic circuit formed between the hydraulic motor 220 and the hydraulic valve means 221 may be needed in order to compensate for the leakage of hydraulic fluid from the hydraulic motor 220.

The invention is not limited to the kind of a brake devices shown in the figures, but can be used with any kind of brake devices. The brake device may be realized e.g. based on a magnetic switch or based on a mechanical switch or based on a drum brake. The brake device may also be realized with a disc brake provided with several brake discs. The brake pads may be operated by any force e.g. so that the brake pads are pressed with spring forced and released with hydraulic, magnetic or some other force.

The invention is not limited to the differential shown in FIG. 4. The steering arrangement can be used in connection with any kind of differential comprising three shafts. Power can be distributed from one shaft to the two remaining shafts. One shaft can on the other hand be locked from rotation, whereby power can be distributed between the two remaining shafts. A first shaft may be connected to a ring gear within the differential. A second shaft may be connected to a first side gear within the differential. A third shaft may be connected to a second side gear within the differential.

The differential 100 is in FIG. 2 positioned between the angle transmission 53 and the steering electric motor 60 and in FIG. 3 between the main pinion gear 51 and the planetary gear 52. The differential 100 could, however, be positioned anywhere in the force transmission arrangement 50 between the gearwheel 40 and the steering electric motor 60.

The hydraulic fluid used in the hydraulic systems may be oil.

The brake device 200 may be controlled passively or actively.

A passive control of a brake device based on at least one brake pad acting on a brake surface may be realized by setting a predetermined brake force corresponding to a certain friction force in the disc brake. When the friction force is exceeded at a threshold torque produced by an external force on the propulsion unit, the disc brake will begin to slip producing a certain counter torque.

An active control of a brake device based on at least one brake pad acting on a brake surface may be realized by arranging means which open the brake device completely when the threshold torque produced by the external force on the propulsion unit is exceeded. The brake would thus rotate freely after the threshold torque is exceeded. Means being able to detect when the abnormal operational situation is over would be needed so that the brake device could be reset to normal operation when the abnormal operational situation is over.

An active control of a brake device based on at least one brake pad acting on a brake surface may on the other hand be realized by arranging means which control the brake actively when the threshold torque produced by the external force on the propulsion unit is exceeded. The brake could thus be controlled actively during the whole abnormal operational situation. Means being able to detect when the abnormal operational situation is over would be needed so that the brake device could be reset to normal operation when the abnormal operational situation is over.

A passive control of a brake device based on a hydraulic motor may be realized by setting a predetermined pressure in the relief valve. When the predetermined pressure is exceeded in the relief valve at a threshold torque produced by an external force on the propulsion unit, the hydraulic motor will begin to rotate producing a certain counter torque caused by the remaining restriction of the flow of the hydraulic fluid in the hydraulic circuit between the hydraulic motor and the relief valve. The flow of hydraulic fluid through the hydraulic motor would thus still be passively restricted.

An active control of a brake device based on a hydraulic motor may be realized by arranging means which open a non-restricted flow path through the hydraulic motor e.g. by by-passing the relief valve when the threshold torque produced by the external force is exceeded. The flow of hydraulic fluid through the hydraulic motor would thus not be restricted at all. Means being able to detect when the abnormal operational situation is over would be needed so that the brake device could be reset to normal operation when the abnormal operational situation is over.

An active control of a brake device based on a hydraulic motor may on the other hand be realized by arranging means which control the flow path through the hydraulic motor actively when the threshold torque produced by the external force is exceeded. The flow of hydraulic fluid through the hydraulic motor would thus be controlled actively during the whole abnormal operational situation. Means being able to detect when the abnormal operational situation is over would be needed so that the brake device could be reset to normal operation when the abnormal operational situation is over.

The arrangement is not limited to the propulsion unit shown in the figures. The arrangement can naturally be used also in connection with e.g. a mechanical drive unit. The driving electric motor 30 could thus be positioned in the upper portion 22 of the strut 21 or in the interior of the vessel 10. A vertical shaft would then be needed to connect the propeller shaft 31 to the driving electric motor 30. A slip ring arrangement 70 would not be needed in case the driving electric motor 30 would be positioned within the interior of the vessel 10.

The invention and its embodiments are not limited to the examples described above but may vary within the scope of the claims.

The invention claimed is:

1. A propulsion unit provided with a steering arrangement comprising:

at least one steering electric motor for rotating the propulsion unit via a force transmission arrangement arranged between the propulsion unit and the steering electric motor, wherein:

the force transmission arrangement comprises a differential comprising a first shaft rotationally connected to the steering electric motor, a second shaft rotationally connected to the propulsion unit, and a third shaft rotationally connected to a brake device, the third shaft is locked from rotation when a torque produced by an external force on the propulsion unit is below a threshold value, whereby power is distributed only from the steering electric motor to the rotation of the propulsion unit or vice a versa, and the third shaft is allowed to start rotating when the torque produced by the external force on the propulsion unit exceeds the threshold value, whereby power is distributed from the steering electric motor to the rotation of the propulsion unit and to the brake device or from the rotation of the propulsion unit to the steering electric motor and to the brake device.

2. The propulsion unit according to claim 1, which further comprises a gearwheel is connected to the propulsion unit, whereby the force transmission arrangement is arranged between the gearwheel and the steering electric motor.

3. The propulsion unit according to claim 1, wherein the first shaft is connected to a ring gear within the differential, the second shaft is connected to a first side gear within the differential, and the third shaft is connected to a second side gear within the differential.

4. The propulsion unit according to claim 3, wherein the brake device is connected operatively to the second shaft or to the third shaft of the differential.

5. The propulsion unit according to claim 4, wherein the gearwheel is connected operatively to the first shaft or to the one of the second shaft and the third shaft that is not connected to the brake device.

6. The propulsion unit according to claim 5, wherein the steering electric motor is connected operatively to the remaining one of the three shafts.

7. The propulsion unit according to claim 3, wherein the first shaft is connected within the differential to a pinion gear and the pinion gear is connected within the differential to the ring gear.

8. The propulsion unit according to claim 3, wherein at least one spider gear meshes with the side gears, the at least one sider gear being rotatable connected to a support frame, the support frame being fixedly attached to the ring gear, whereby the at least one spider gear is free to rotate with the ring gear and around its own rotation axis.

9. The propulsion unit according to claim 2, wherein the force transmission arrangement between the gearwheel and the steering electric motor comprises a main pinion gear connected to the gearwheel, the differential, and a planetary gear connected to the steering electric motor.

10. The propulsion unit according to claim 1, wherein the brake device is based on at least one brake pad acting on a brake surface connected operatively to the shaft of the differential that is connected operatively to the brake device, whereby a predetermined brake force corresponding to a certain friction force in the brake surface is set so that the brake surface will begin to slip in relation to the at least one brake pad producing a certain counter torque when the friction force is exceeded at a threshold torque produced by an external force on the propulsion unit.

11. The propulsion unit according to claim 1, wherein the brake device is based on at least one brake pad acting on a brake surface connected operatively to the shaft of the differential that is connected operatively to the brake device, whereby a predetermined brake force corresponding to a certain friction force in the brake disc is set so that the brake disc is released to rotate freely in relation to the at least one brake pad when the friction force is exceeded at a threshold torque produced by an external force on the propulsion unit.

12. The propulsion unit according to claim 1, wherein the brake device is based on a hydraulic motor connected operatively to the shaft of the differential that is connected operatively to the brake device, whereby a predetermined pressure is set in a relief valve connected to the hydraulic motor so that the hydraulic motor will begin to rotate producing a certain counter torque caused by the remaining restriction of the flow of the hydraulic fluid in the hydraulic circuit between the hydraulic motor and the relief valve when the predetermined pressure is exceeded at a threshold torque produced by an external force on the propulsion unit.

13. The propulsion unit according to claim 1, wherein the brake device is based on a hydraulic motor connected operatively to the shaft of the differential that is connected operatively to the brake device, whereby a predetermined pressure is set in a relief valve connected to the hydraulic motor so that the hydraulic motor is released to rotate freely when the predetermined pressure is exceeded at a threshold torque produced by an external force on the propulsion unit.

14. The propulsion unit according to claim 1, wherein the propulsion unit comprises a hollow strut with an upper portion and a lower portion, the upper portion being connected operatively to the gearwheel and forming a support arm for the lower portion, the lower portion forming a longitudinal compartment, a propeller shaft being rotatably supported within the compartment, at least one propeller being attached to at least one outer end of the propeller shaft outside the lower portion.

15. A vessel comprising a propulsion unit according to claim 14.

16. The propulsion unit according to claim 2, wherein the first shaft is connected to a ring gear within the differential, the second shaft is connected to a first side gear within the differential, and the third shaft is connected to a second side gear within the differential.

17. The propulsion unit according to claim 16, wherein the brake device is connected operatively to the second shaft or to the third shaft of the differential.

18. The propulsion unit according to claim 17, wherein the gearwheel is connected operatively to the first shaft or to the one of the second shaft and the third shaft that is not connected to the brake device.

19. The propulsion unit according to claim 18, wherein the steering electric motor is connected operatively to the remaining one of the three shafts.

20. The propulsion unit according to claim 4, wherein at least one spider gear meshes with the side gears, the at least one sider gear being rotatable connected to a support frame, the support frame being fixedly attached to the ring gear, whereby the at least one spider gear is free to rotate with the ring gear and around its own rotation axis.

* * * * *